United States Patent [19]

Nishigaki et al.

[11] 4,107,657

[45] Aug. 15, 1978

[54] FLAME DETECTING APPARATUS

[75] Inventors: Susumu Nishigaki; Akio Ohgoshi, both of Tokyo, Japan

[73] Assignee: Sony Corporation, Tokyo, Japan

[21] Appl. No.: 751,747

[22] Filed: Dec. 17, 1976

Related U.S. Application Data

[63] Continuation of Ser. No. 629,330, Nov. 6, 1975, abandoned.

[30] Foreign Application Priority Data

Nov. 14, 1974 [JP] Japan ..... 49-131375

[51] Int. Cl.[2] ..... G08B 17/12

[52] U.S. Cl. ..... 340/579

[58] Field of Search ..... 340/227 R, 228.1

[56] References Cited

U.S. PATENT DOCUMENTS

| | | | |
|---|---|---|---|
| 2,127,977 | 8/1938 | Lamb | 340/228.1 |
| 2,820,945 | 1/1958 | Marsden, Jr. | 340/228.1 |
| 3,301,307 | 11/1967 | Nishigaki et al. | 340/228.1 |
| 3,302,685 | 2/1967 | Ono et al. | 340/228.1 |
| 3,836,857 | 9/1974 | Ikegami et al. | 340/228.1 |

*Primary Examiner*—Glen R. Swann, III

*Attorney, Agent, or Firm*—Hill, Gross, Simpson, Van Santen, Steadman, Chiara & Simpson

[57] ABSTRACT

A flame detecting apparatus comprises a flame detecting electrode and an auxiliary electrode both of which are in use disposed in a flame, and means to bias the auxiliary electrode to a DC potential different from that of the detecting electrode.

1 Claim, 7 Drawing Figures

FLAME DETECTING APPARATUS

This is a continuation of application Ser. No. 629,330, filed Nov. 6, 1975 now abandoned.

BACKGROUND OF THE INVENTION

1. Field of the Invention

This invention relates to a flame detecting apparatus, more paraticulary to a novel flame detecting apparatus in which a flame detecting electrode and an auxiliary electrode are disposed in a flame.

2. Description of the Prior Art

In many application, domestic, commercial and industrial, flame combustion of a fuel is used as a source of heat. It is essential, in the interests of safety, that there should at no time be an accumulation of unburnt gases in the combustion chamber (such as will occur on flame failure) which may be accidentally ignited and cause an explosion. Therefore, it is necessary to have some means for detecting and giving an indication of flame failure, the means preferably stopping the supply of fuel to the combustion chamber. Many types of flame detector are available to indicate flame failure and prevent the build-up of this potentially hazardous condition. These flame detectors are usually based on one of the following principles:

(1) thermostat effect;

(2) action of light sensitive thermionic tubes; and (3) electrical properties of flame gases.

The flame detectors based on either of the first principles are subject to fundamental problems. Thermostats have a slow response time because of the finite time between flame failure and the detection of cooling which gives an indication of the flame failure. On the other hand, light sensitive thermionic tubes require delicate and expensive amplifying means. These devices also require accompanying fault detection equipment to ensure that they are operating properly.

The third principle on which flame detectors have been based involves making use of the electrical properties inherent in flame gases, for example electrical conductivity or rectification. A flame detector using the electrical conductivity or rectification action of a flame has a voltage of several hundred volts AC applied between a flame detecting electrode and a burner, and a minute current which is caused to flow through the flame between the detecting electrode and the burner is amplified by an amplifier circuit of high input impedance which employs a field-effect transistor or the like. Alternatively, a light emitting device, such as a neon tube, is caused to emit light by the use of the minute current, and a photo-conductive device is operated by the emitted light. The applied voltage may, for example, be 250 volts AC, with the detected current only being some 4 microamps.

In another type of flame detector using the third principle, only the detecting electrode inserted into the flame is used. This type uses the fact that some of the atoms or molecules in a flame are thermally ionized by the high temperature, that is, there are many positive ions of $H_3O^+$ in the top region of the flame and many negative ions of $Ho^-$ in the bottom region of the flame. Also many electrons produced by the thermal ionization are present in the middle region of the flame. It may be said, therefore that the flame is an electrical conductor, although with a very large impedance. When an electrode is disposed in the flame, the electrons are caught by the electrode one by one, so that a current flows through the flame, the electrode being charged to negative potential. This negative potential is used as a detecting signal. However, generally, the detecting voltage is very small, for example, 0.6 to 0.8 volts, and the current is also very small, for example 50 to 120 nanoamps.

With the known flame detectors therefore a quick and reliable response cannot be obtained, because the detecting signals are so small.

SUMMARY OF THE INVENTION

It is accordingly an object of the invention to provide a flame detecting apparatus which is free from the disadvantages of the known apparatus described above.

Another object of the invention is to provide a flame detecting apparatus in which a detecting and an auxiliary electrode are disposed in a flame, and one of electrodes in biased to a DC potential different from that of the other electrode.

Still another object of the invention is to provide a flame detecting apparatus in which a detecting and an auxiliary electrode are disposed in a flame, and a negative biasing means is connected to the auxiliary electrode, whereby certain flame detection and quick response are obtained.

Still another object of the invention is to provide a flame detecting apparatus in which a detecting and an auxiliary electrode are disposed in a flame, and a biasing means is provided such that the DC potential of the detecting electrode is higher than that of the auxiliary electrode, whereby a relatively large detecting voltage and current is obtained.

Yet another object of the invention is to provide a flame detecting apparatus in which two electrodes are disposed in a flame, and a biasing voltage source is provided, so that the flame detecting apparatus is easily constructed and a stable output is obtained.

BRIEF DESCRIPTION OF THE DRAWINGS

Further objects, features and advantages of the invention will become apparent from the following description given by way of example, with reference to the accompanying drawings, in which.

DESCRIPTION OF THE PREFERRED EMBODIMENTS

Figure 1:
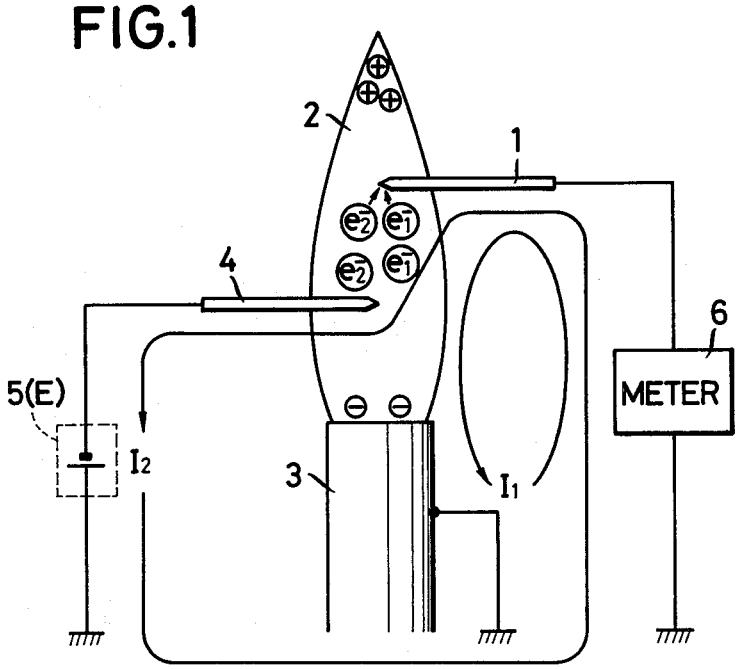
FIGS. 1 and 2 are diagrammatic views respectively of first and second embodiments of the invention.

Referring now to the drawings, FIG. 1 shows a flame detecting apparatus in which a detecting electrode 1 is disposed in a flame 2 from a grounded burner 3. An auxiliary electrode 4 is also disposed in the flame 2, but positioned below the detecting electrode 1. The DC potential of the detecting electrode 1 is maintained higher than that of the auxiliary electrode 4, the auxiliary electrode 4 being biased to a negative potential by a DC voltage source 5. An indicator such as a voltmeter 6, or an ammeter, is connected between the detecting electrode 1 and ground.

Some of the atoms or molecules in the flame 2 are thermally ionized by the high temperature, so there are many positive ions of $H_3O^+$ which have lost electrons in the top region of the flame 2 and many negative ions of $HO^-$ in the bottom region of the flame 2. Also, there are many electrons $e_1^-$ produced by the thermal ionization in the middle region of the flame 2. The electrons $e_1^-$ are caught by the detecting electrode 1 so that a current $I_1$ flows through the flame 2 from the electrode 1 to the burner 3, which means that the detecting electrode 1 is charged to a negative potential. Also, since the auxiliary electrode 4 is substantially heated by the flame 2, many thermal electrons $e_2^-$ are discharged therefrom, and are caught by the detecting electrode 1. Thus, a second current $I_2$ flows through the flame 2 from the detecting electrode 1 to the auxiliary electrode 4, so the detecting electrode 1 is still further charged to a negative potential. Thus a large current flows through flame 2 and a large voltage is developed at the detecting electrode 1.

Figure 2:
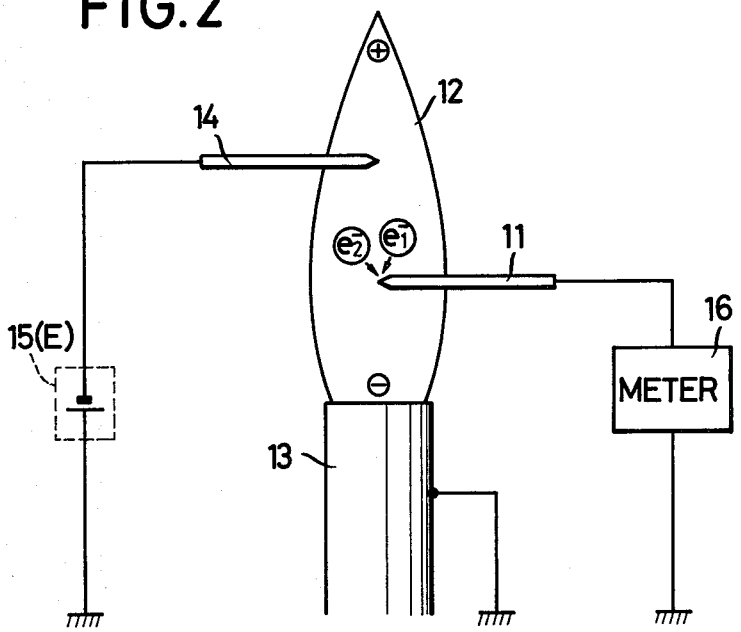

FIG. 2 shows a second embodiment. In this case, detecting and auxiliary electrodes 11 and 14 are disposed in a flame 12 as in the first embodiment, but the detecting electrode 11 is positioned under the auxiliary electrode 14, which is biased with a negative potential relative to the detecting electrode 11 by a DC voltage source 15. Numerals 13 and 16 designate the burner and an indicator, respectively.

Figure 3:
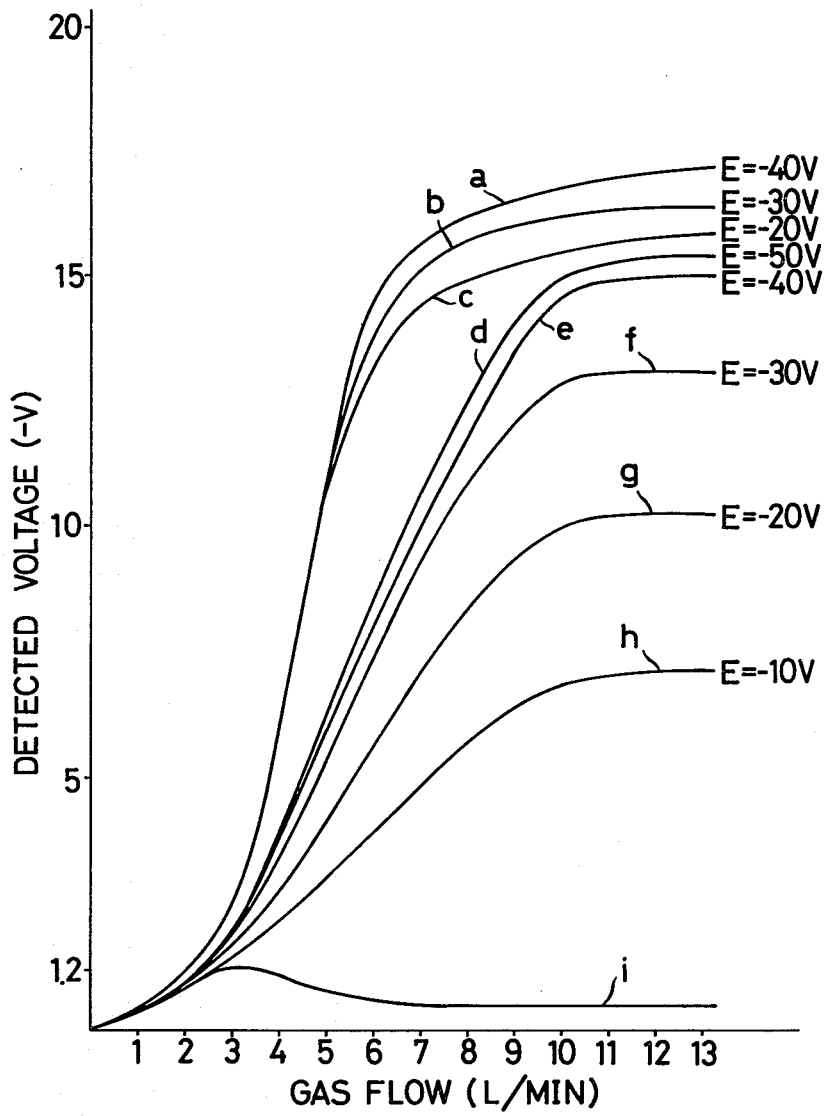
FIGS. 3 and 4 are graphs of detected voltage and current plotted against gas flow for the first and second embodiments respectively.

FIG. 3 shows graphs of the detected negative voltage plotted against the gas flow in liters per minute with a constant air supply for the first and second embodiments shown in FIGS. 1 and 2. Curves (*a*), (*b*) and (*c*) show changes of detected voltage when the source 5 (FIG. 1) has various voltages (E), namely; $E = -40$, $-30$ and $-20$ volts. Curves (*d*), (*e*), (*f*), (*g*) and (*h*) show changes of detected voltage when the source 15 (FIG. 2) has various voltages (E), namely; $E = -50$, $-40$, $-30$, $-20$ and $-10$ volts. Additionally, a curve (i) shows changes of a detected voltage in a prior art apparatus in which only the detecting electrode is inserted into a flame.

Figure 4:
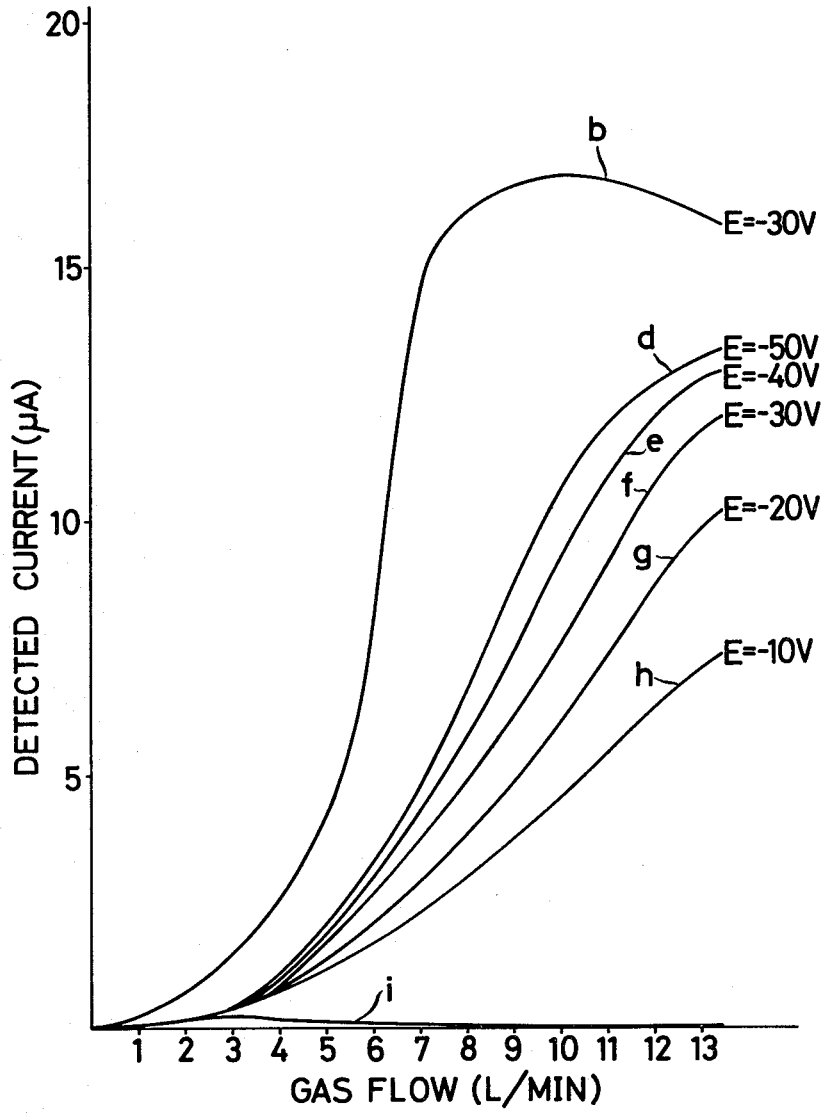

FIG. 4 shows graphs of the detected current plotted against the gas flow for the first and second embodiments. Curves (*b*), (*d*), (*e*), (*f*), (*g*), (*h*) and (*i*) correspond to curves (*b*), (*d*), (*e*), (*f*), (*g*), (*h*) and (*i*) in FIG. 3. It can be seen from the curves (*b*) shown in FIGS. 3 and 4, that when $-30$ volts is applied to the auxiliary electrode 4 in the first embodiment, $-16$ volts and 17 microamps is detected. Similarly, curves (*d*) shown in FIGS. 3 and 4, show that when $-50$ volts is applied to the auxiliary electrode 14 of the second embodiment, $-15.5$ volts and 13.8 microamps is detected. Thus, the detected voltage and current are very large compared with those shown by the curve (*i*) for the prior art apparatus.

As shown in FIGS. 3 and 4, the detected voltage and current with the first embodiment in which the auxiliary electrode 4 is placed under the detecting electrode 1 are larger than those obtained with the second embodiment. It is thought that, in the first embodiment of FIG. 1, two kinds of electrons $e_1^-$ and $e_2^-$ flow towards the top region of the flame 2. That is, both kinds of electrons $e_1^-$ and $e_2^-$ flow easily towards the positive ions which exist in the top region of the flame 2, and are assisted by the flow of gases from the bottom to the top of the flame 2.

Figure 5:
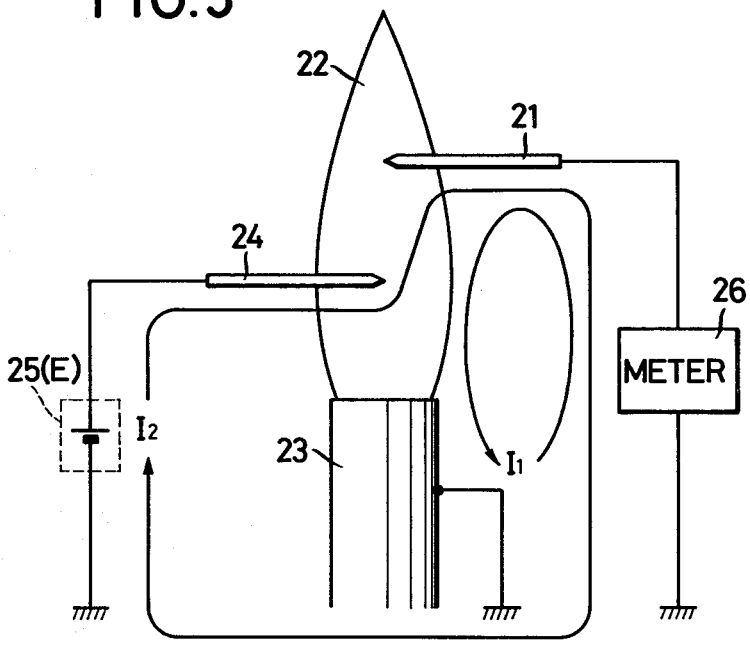
FIGS. 5 and 6 are diagrammatic views respectively of third and fourth embodiments of the invention.

FIG. 5 shows a third embodiment. Detecting electrode 21 and auxiliary electrode 24 are disposed in a flame 22. The auxiliary electrode 24 is disposed under the detecting electrode 21, but is energized by a positive voltage source 25. Numerals 23 and 26 designate the burner and an indicator, respectively. In this embodiment, when $+30$ volts is applied to the auxiliary electrode 24, $+3$ volts is detected at and 0.5 microamps flows to the detecting electrode 21 with a gas flow of 13 liters per minute.

Figure 6:
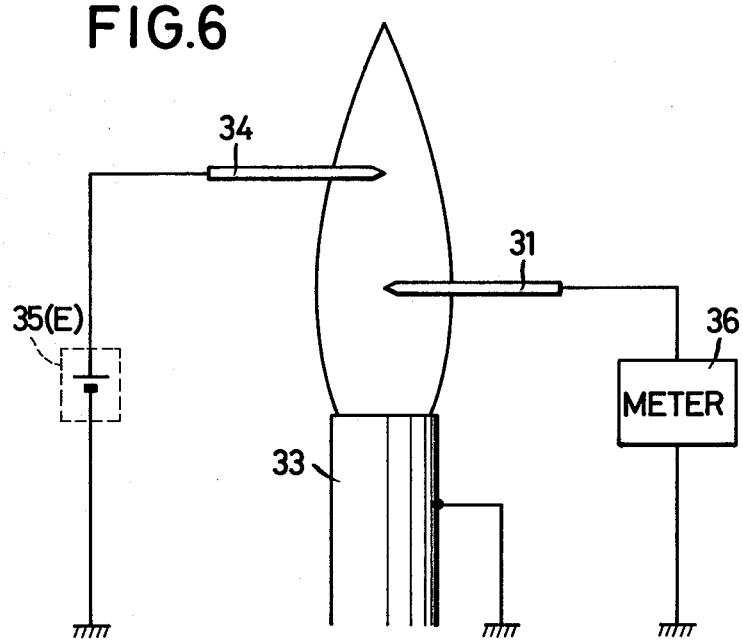

FIG. 6 shows a fourth embodiment. In this case, an auxiliary electrode 34 is positioned above a detecting electrode 31 and is energized by a positive voltage source 35. An indicator 36 is provided. When the auxiliary electrode 34 is biased with $+30$ volts, $+4$ volts is detected at and 0.5 microamps flows to the detecting electrode 31.

Thus, in the third and fourth embodiments, a low positive voltage is detected at the respective detecting electrodes. It is thought that, in the third embodiment shown in FIG. 5, the detecting electrode 21 is charged with negative potential as mentioned above, but on the other hand, a current $I_2$ flows through the flame 22 from the auxiliary electrode 24 to the detecting electrode 21, as indicated, due to the positive source 25, so that a positive potential is developed at the detecting electrode 21. This positive potential overcomes the above-mentioned negative potential, so that a small positive potential appears at the detecting electrode 21.

A preferred material for the detecting electrode comprises 0.1% barium, 0.2% magnesium, 0.1% carbon and the balance nickel. It is possible to use more than one element, having work function less than 3 eV from group IIa of the periodic table, for example, magnesium, calcium, strontium or barium. The work functions of all these elements is less than 3 eV, so an electrode comprising one or more of these elements can easily gather the electrons $e_1^-$ produced by thermal ionization, so that a substantial negative potential is developed at the detecting electrode. Other examples of materials for a detecting electrode are as follows:

1. Chromium 12 to 15%, silicon less than 0.5%, carbon less than 0.15%, strontium 0.1%, copper 0.1% and the balance nickel.

2. Chromium 23%, aluminium 6%, cobalt 2%, carbon less than 0.1%, strontium 0.1% and the balance iron.

3. Chromium 18%, nickel 8%, silicon less than 1%, manganese less than 2%, carbon less than 0.03%, stronium 1%, calcium 1% and the balance iron. All the above percentages are by weight.

Figure 7:
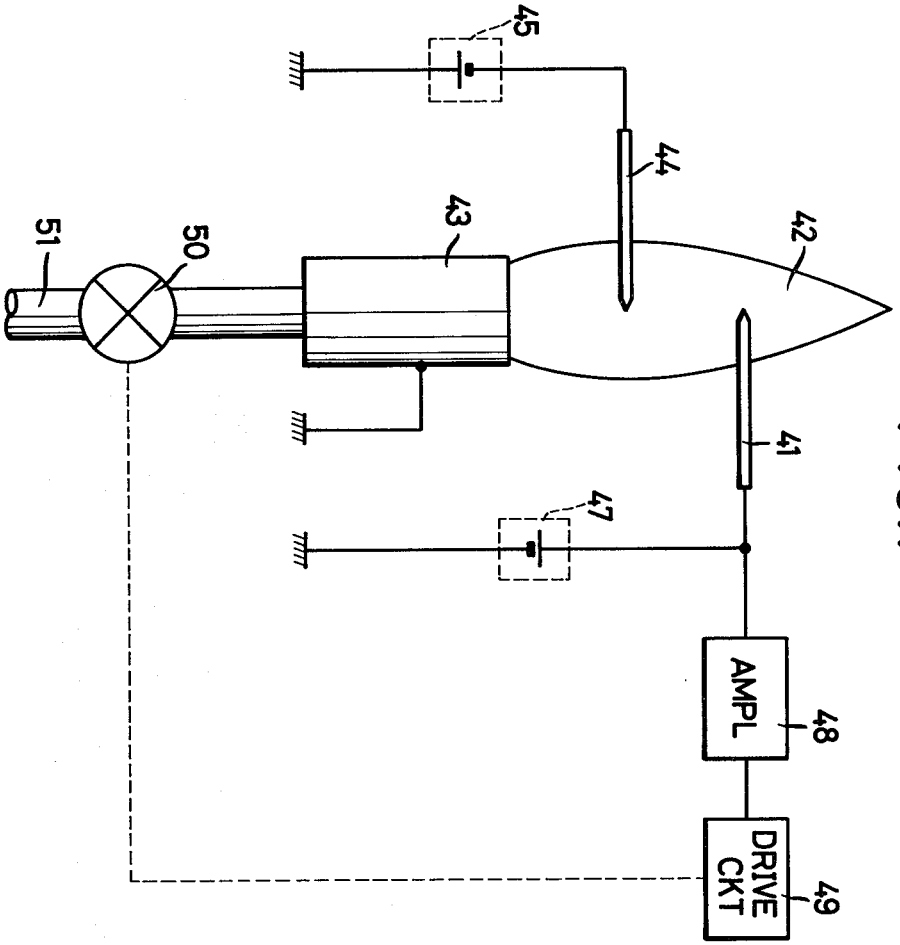
FIG. 7 is a diagrammatic view with a block diagram of a fifth embodiment of the invention.

FIG. 7 shows a fifth embodiment. In this case, detecting and auxiliary electrodes 41 and 44 are disposed in a flame 42 from a burner 43, the auxiliary electrode 44 being biased with a negative potential by a negative DC voltage source 45. In this embodiment, an additional biasing source 47 is connected to the detecting electrode 41 so as to bias the detecting electrode 41 with a positive DC potential. With this embodiment a large detected signal is obtained and is applied to an amplifier 48, the output of which is supplied to a drive circuit 49 which may include a suitable switching element and relay. The output of the drive circuit 49 controls a valve 50 in a gas supply pipe 51. If the flame 42 goes out, no output is applied to the valve 50 and no gas is supplied to burner 43.

Although described in relation to a gas flame, the invention can of course be used with flames produced by other fuels.

Moreover, other modifications and variations will be apparent to those skilled in the art and are included in the scope of the invention which is defined by the appended claims.

We claim:

1. A method of detecting the presence or absence of a flame at a flame position, said method comprising disposing a first electrode in said flame, said first electrode including a metal having a work function of less than 3 eV, disposing a second electrode in said flame at a level lower than said first electrode, biasing said second electrode with a negative direct current voltage, said first electrode having a direct current potential higher than said second electrode, and deriving a signal from said first electrode, which signal indicates whether a flame is present or not.

* * * * *